US011619452B2

(12) United States Patent
Zhang

(10) Patent No.: US 11,619,452 B2
(45) Date of Patent: Apr. 4, 2023

(54) CAPILLARY STRUCTURE OF VAPOR CHAMBER AND THE VAPOR CHAMBER

(71) Applicant: ASIA VITAL COMPONENTS (CHINA) CO., LTD., Shenzhen (CN)

(72) Inventor: Jian Zhang, Shenzhen (CN)

(73) Assignee: ASIA VITAL COMPONENTS (CHINA) CO., LTD., Shenzhen (CN)

( * ) Notice: Subject to any disclaimer, the term of this patent is extended or adjusted under 35 U.S.C. 154(b) by 46 days.

(21) Appl. No.: 16/939,066

(22) Filed: Jul. 27, 2020

(65) Prior Publication Data

US 2022/0026161 A1 Jan. 27, 2022

(51) Int. Cl.
*F28D 15/04* (2006.01)

(52) U.S. Cl.
CPC ..... *F28D 15/046* (2013.01)

(58) Field of Classification Search
CPC ... F28D 15/046; F28D 15/04; H05K 7/20336; H05K 7/2029; H01L 23/427
See application file for complete search history.

(56) References Cited

U.S. PATENT DOCUMENTS 6,082,443 A * 7/2000 Yamamoto ..... F28D 15/0233 165/104.21
7,770,631 B2 * 8/2010 Wang ..... F28D 15/0233 165/104.26
8,757,247 B2 * 6/2014 Yang ..... F28D 15/0233 165/104.26
8,813,834 B2 * 8/2014 Chin ..... H01L 23/427 165/104.26
9,664,458 B2 * 5/2017 Lin ..... F28D 15/046
11,131,508 B2 * 9/2021 Sheng ..... F28D 15/046
2002/0020518 A1 * 2/2002 Li ..... F28D 15/0233 165/104.11

(Continued)

FOREIGN PATENT DOCUMENTS

CN 101354221 A 1/2009
CN 206192158 U 5/2017

(Continued)

OTHER PUBLICATIONS

Search Report dated Feb. 19, 2021 issued by Taiwan Intellectual Property Office/for counterpart application No. 109121179.

*Primary Examiner* — Tho V Duong
(74) *Attorney, Agent, or Firm* — Demian K. Jackson; Jackson IPG PLLC

(57) ABSTRACT

A capillary structure of vapor chamber and the vapor chamber. The capillary structure of vapor chamber includes a sintered main body. The sintered main body has multiple perforations and multiple extension sections integrally extending from one side of the sintered main body. The extension sections are arranged at intervals or not arranged at intervals to support the sintered main body. The vapor chamber includes a first plate body and a second plate body. The first and second plate bodies are correspondingly mated with each other to together define an airtight chamber. The second plate body has a heated section and a first capillary structure. The sintered main body is correspondingly disposed in the heated section and supported on (overlapped with) the first capillary structure. By means of the extension sections, the sintered main body and the first capillary structure define therebetween a gap.

8 Claims, 7 Drawing Sheets

(56) References Cited

U.S. PATENT DOCUMENTS

| | | | | |
|---|---|---|---|---|
| 2007/0240860 | A1* | 10/2007 | Meyer | F28D 15/0233 165/104.26 |
| 2011/0315351 | A1* | 12/2011 | Meyer, IV | F28D 15/0233 165/104.26 |
| 2012/0168435 | A1* | 7/2012 | Chen | F28D 15/04 220/6 |

FOREIGN PATENT DOCUMENTS

| | | | |
|---|---|---|---|
| TW | M601333 | U | 9/2020 |
| WO | 2020026908 | A1 | 2/2020 |

* cited by examiner

CAPILLARY STRUCTURE OF VAPOR CHAMBER AND THE VAPOR CHAMBER

BACKGROUND OF THE INVENTION

1. Field of the Invention

The present invention relates generally to a capillary structure of vapor chamber and the vapor chamber, and more particularly to a capillary structure of vapor chamber and the vapor chamber, which can improve the thermal resistance problem due to the over-thickened capillary structure or the multilayered capillary structure.

2. Description of the Related Art

The vapor chamber is a heat conduction component often used to conduct heat. The vapor chamber has an internal vacuum airtight chamber. A capillary structure is disposed on the wall face of the vacuum airtight chamber and a working liquid is filled in the vacuum airtight chamber so as to conduct heat by means of vapor-liquid circulation.

It is known that an outer side of the vapor is in contact with at least one heat source to conduct the heat. The outer side of the vapor chamber absorbs the heat of the heat source to directly conduct the heat to the internal vacuum airtight chamber (evaporation section) of the vapor chamber. After the working liquid is evaporated, the vapor working fluid spreads to the other side (condensation section) to be condensed into liquid working fluid. The liquid working fluid then flows back to continue the circulation. The side of the airtight chamber corresponding to the heat source must be rich in working liquid so as to avoid dry burn. To increase the water content of the evaporation section, the conventional technique employs thickened capillary structure or multilayered capillary structure to increase the working liquid content of the evaporation section so as to avoid dry burn.

The thickened capillary structure or the multilayered capillary structure can greatly increase the water content of the evaporation section. However, the meshes and/or voids of the thickened capillary structure or the multilayered capillary structure are often blocked or narrowed due to the over-thickened capillary structure or the multilayered capillary structure. As a result, when the working liquid is heated and evaporated at the evaporation section, the blocked or narrowed will lead to thermal resistance. The thickened capillary structure and/or the multilayered capillary structure can greatly increase the water content of the evaporation section. However, the thickened capillary structure and/or the multilayered capillary structure will block the vapor so that after evaporated, the working fluid at the evaporation section cannot spread and the heat is locked in the evaporation section. As a result, the working fluid will stop vapor-liquid circulation and the vapor chamber will fail to conduct the heat.

It is therefore tried by the applicant to provide a capillary structure of vapor chamber and the vapor chamber, which can improve the shortcomings existing in the conventional vapor chamber.

SUMMARY OF THE INVENTION

It is therefore a primary object of the present invention to provide a capillary structure of vapor chamber and a vapor chamber having the capillary structure. The capillary structure of vapor chamber and the vapor chamber not only can increase the water content of the evaporation section of the vapor chamber, but also can solve the thermal resistance problem caused by the multilayered capillary structure.

To achieve the above and other objects, the capillary structure of vapor chamber of the present invention includes a sintered main body. The sintered main body has multiple perforations and multiple extension sections integrally extending from one side of the sintered main body. The extension sections are arranged at intervals or not arranged at intervals to support the sintered main body. Each two adjacent extension sections define therebetween a passage.

Still to achieve the above and other objects, the vapor chamber of the present invention includes a first plate body, a second plate body and a sintered main body.

The first plate body has a first face and a second face. The second plate body has a third face and a fourth face. The first and second plate bodies are correspondingly mated with each other to together define an airtight chamber. A working liquid is filled in the airtight chamber. The third face has a first capillary structure and a heated section. The sintered main body has multiple perforations and multiple extension sections integrally extending from one side of the sintered main body to support the sintered main body. The sintered main body is disposed in the heated section and supported on (overlapped with) the first capillary structure. By means of the extension sections, the sintered main body and the first capillary structure define therebetween a gap so as to avoid thermal resistance in the evaporation section due to the multiple layers of capillary structures, which are supported on (overlapped with) each other.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
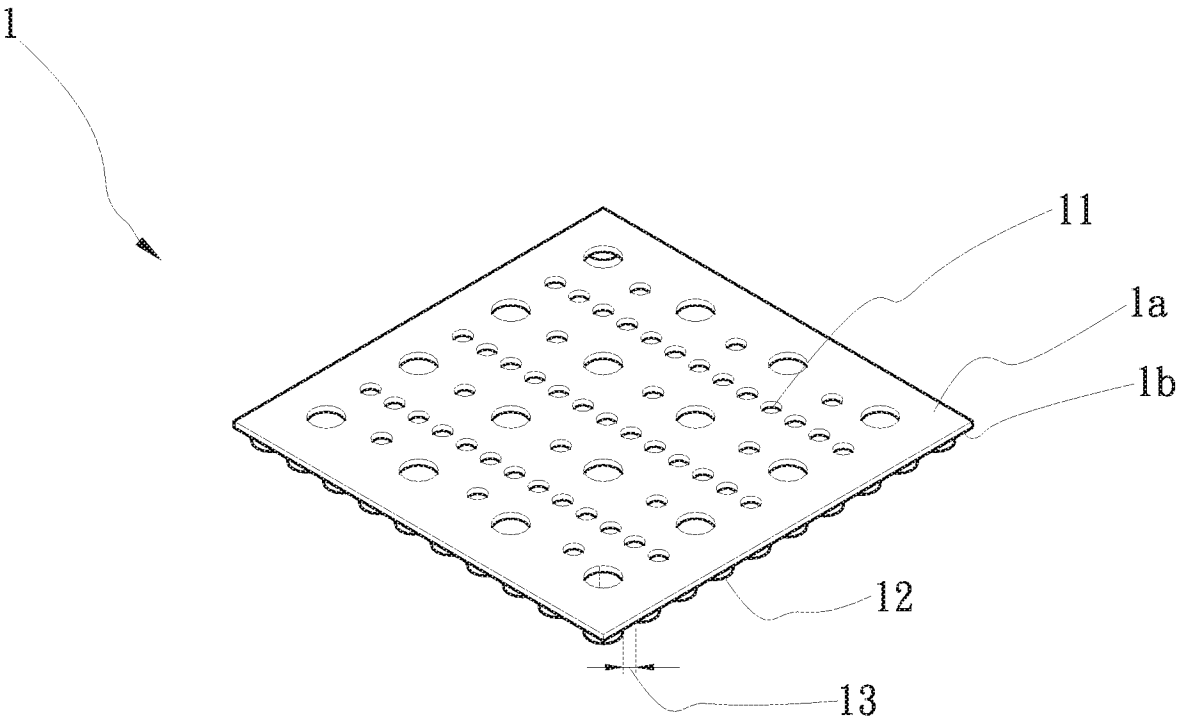
FIG. 1 is a perspective view of a first embodiment of the capillary structure of vapor chamber of the present invention.

Please refer to FIG. 1, which is a perspective view of a first embodiment of the capillary structure of vapor chamber of the present invention. As shown in the drawing, the capillary structure of vapor chamber of the present invention includes a sintered main body 1.

The sintered main body 1 has multiple perforations 11, multiple extension sections 12, a first surface 1*a* and a second surface 1*b*. The first and second faces 1*a*, 1*b* are respectively positioned on upper and lower sides of the sintered main body 1. The extension sections 12 extend from one side of the sintered main body 1. (In this embodiment, the extension sections 12 selectively extend from the second surface 1*b* of the sintered main body 1). The extension sections 12 are arranged at intervals or not arranged at intervals to support the sintered main body 1. Each two adjacent extension sections 12 define therebetween a passage 13. The perforations 11 of the sintered main body 1 pass through the sintered main body 1 between two sides thereof (the first and second surface 1*a*, 1*b*).

The perforations 11 are for the evaporated working fluid to spread or for the support structures (such as columns or rings) to pass through. The sintered main body 1 and the extension sections 12 are integrally formed of sintered powder.

Figure 2:
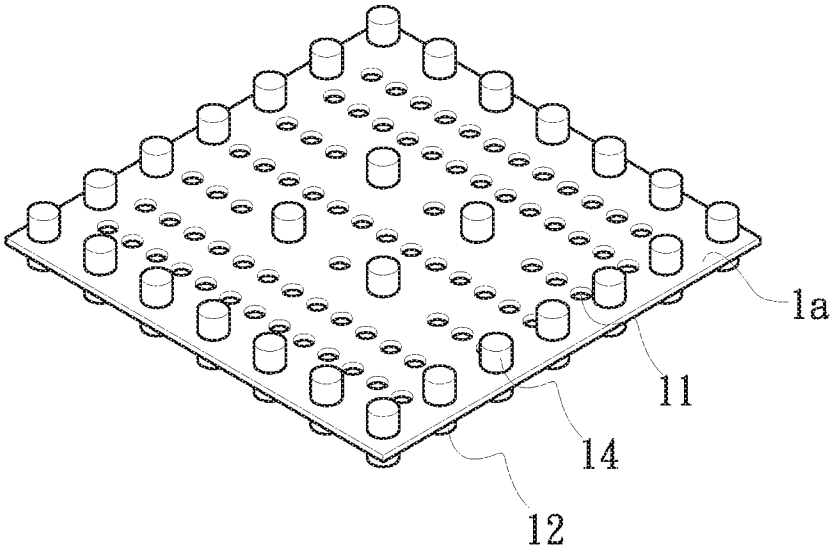
FIG. 2 is a perspective view of a second embodiment of the capillary structure of vapor chamber of the present invention.

Please now refer to FIG. 2, which is a perspective view of a second embodiment of the capillary structure of vapor chamber of the present invention. The second embodiment is partially identical to the first embodiment in structure and thus will not be redundantly described hereinafter. The second embodiment is different from the first embodiment in that multiple support sections 14 are formed on one side (the first surface 1*a*) of the sintered main body 1 opposite to the extension sections 12. The support sections 14 extend from the first surface 1*a* of the sintered main body 1. The extension sections 12 and the support sections 14 are staggered from the perforations 11.

Figure 3:
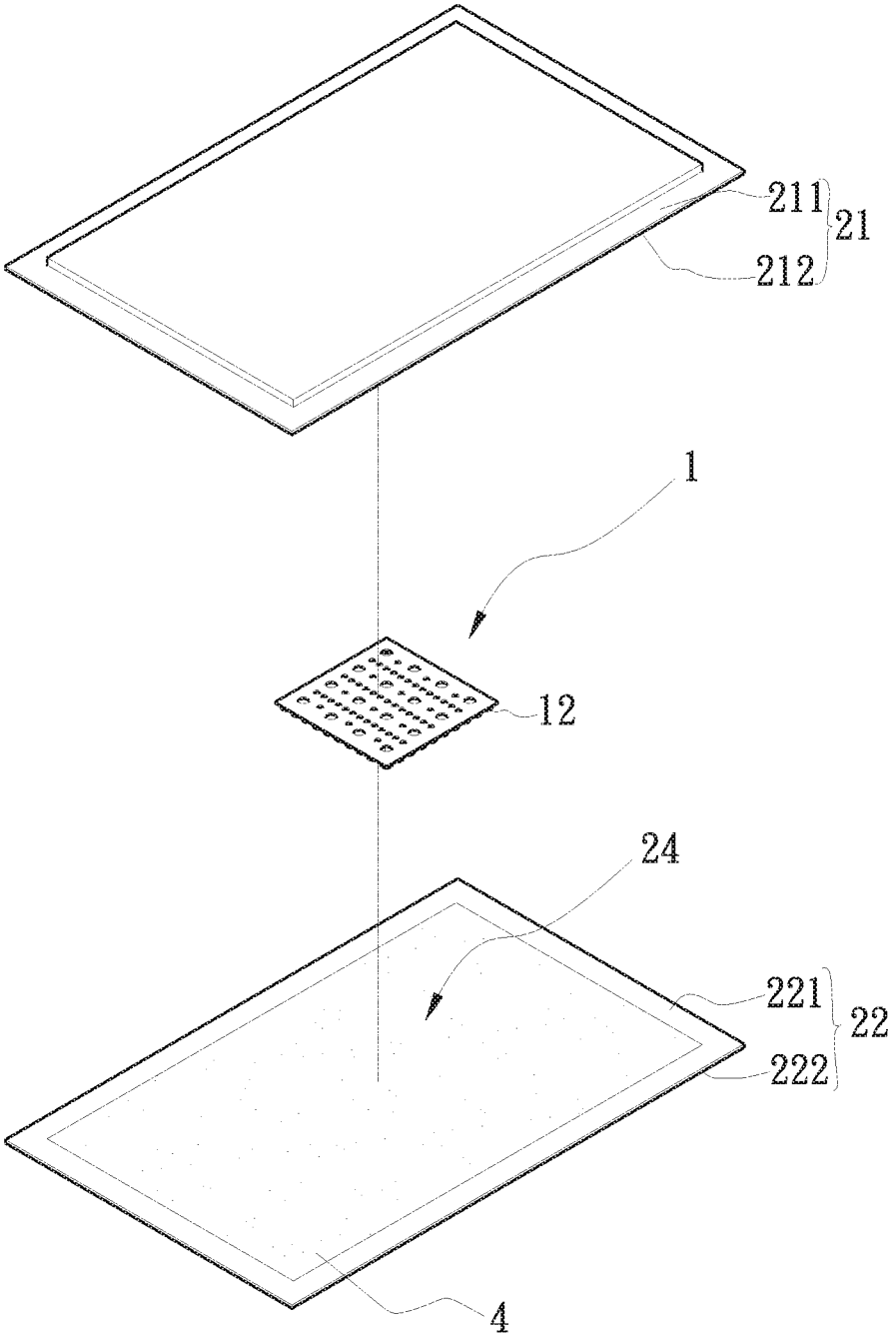
FIG. 3 is a perspective exploded view of a first embodiment of the vapor chamber of the present invention.
Figure 4:
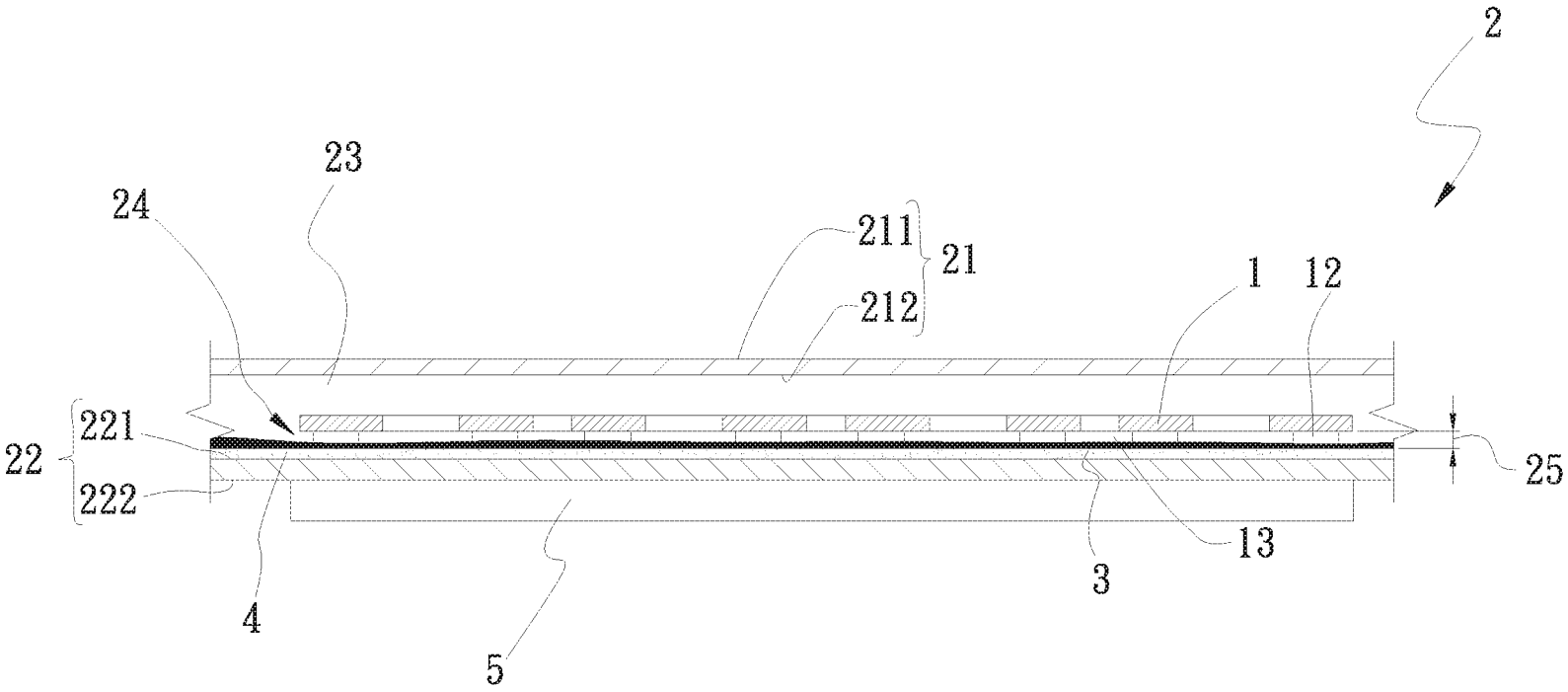
FIG. 4 is a sectional assembled view of the first embodiment of the vapor chamber of the present invention.

Please now refer to FIGS. 3 and 4. FIG. 3 is a perspective exploded view of a first embodiment of the vapor chamber of the present invention. FIG. 4 is a sectional assembled view of the first embodiment of the vapor chamber of the present invention. As shown in the drawings, the vapor chamber 2 of the present invention includes a first plate body 21, a second plate body 22 and a sintered main body 1.

The first plate body 21 has a first face 211 and a second face 212. The first and second faces 211, 212 are respectively positioned on upper and lower sides of the first plate body 21. The second plate body 22 has a third face 221 and a fourth face 222. The third and fourth faces 221, 222 are respectively positioned on upper and lower sides of the second plate body 22. The first and second plate bodies 21, 22 are correspondingly mated with each other to together define an airtight chamber 23. A working liquid 3 is filled in the airtight chamber 23. The third face 221 has a first capillary structure 4 and a heated section 24. The first capillary structure 4 is distributed over the third face 221 of the second plate 22.

A heat source 5 is disposed corresponding to the fourth face 222 of the second plate body 22. The heated section 24 of the third face 221 of the second plate body 22 is disposed corresponding to the heat source 5.

The sintered main body 1 is disposed on the heated section 24. The extension sections 12 are supported on (overlapped with) the first capillary structure 4 and connected therewith. By means of the extension sections 12, the sintered main body 1 and the first capillary structure 4 define therebetween a gap 25.

The first capillary structure 4 is selected from a group consisting of mesh body, fiber body, woven body, channeled body and sintered powder. The first capillary structure 4 can be formed of sintered powder as the sintered main body 1.

Figure 5:
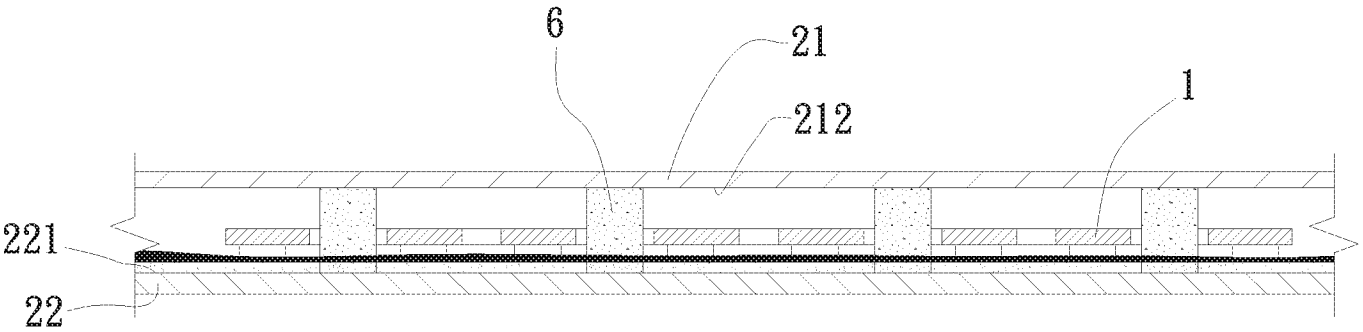
FIG. 5 is a sectional assembled view of a second embodiment of the vapor chamber of the present invention.

Please refer to FIG. 5, which is a sectional assembled view of a second embodiment of the vapor chamber of the present invention. The second embodiment is partially identical to the first embodiment in structure and thus will not be redundantly described hereinafter. The second embodiment is different from the first embodiment in that the second embodiment has multiple support columns 6. The support columns 6 pass through the sintered main body 1. Two ends of the support columns 6 are connected with the second face 212 of the first plate body 21 and the third face 221 of the second plate body 22.

Figure 6:
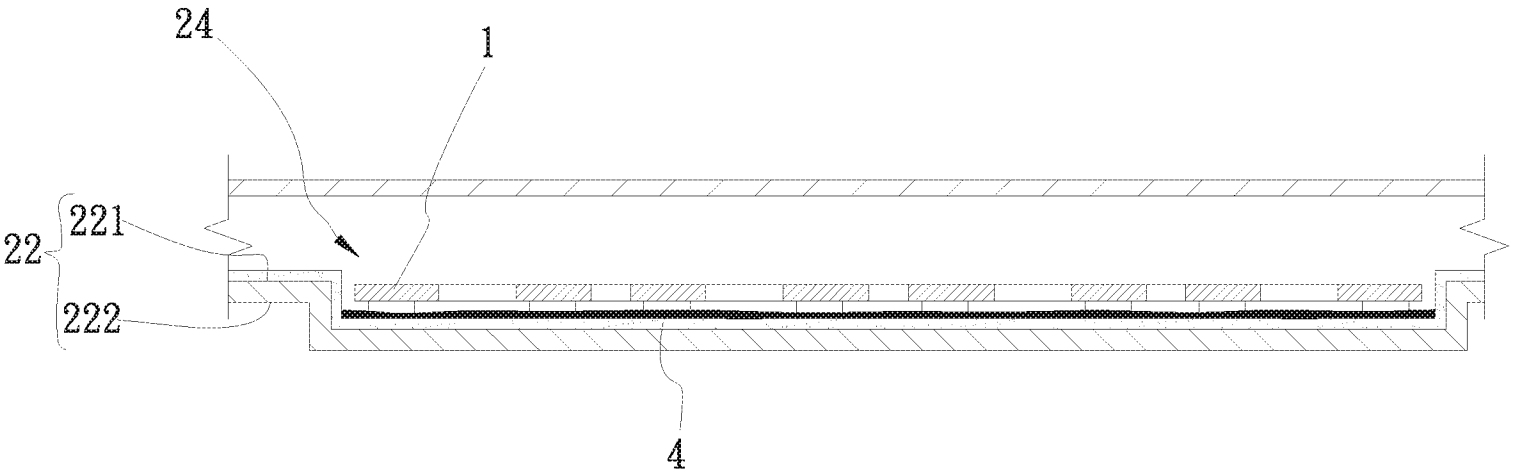
FIG. 6 is a sectional assembled view of a third embodiment of the vapor chamber of the present invention.

Please refer to FIG. 6, which is a sectional assembled view of a third embodiment of the vapor chamber of the present invention. The third embodiment is partially identical to the first embodiment in structure and thus will not be redundantly described hereinafter. The third embodiment is different from the first embodiment in that in the third embodiment, the heated section 24 of the second plate body 22 is raised from the third face 221 to the fourth face 222 of the second plate body 22, whereby the third face 221 is formed with a dented section. The first capillary structure 4 is disposed on the surface of the dented section. The sintered main body 1 is supported on (overlapped with) the first capillary structure 4.

Figure 7:
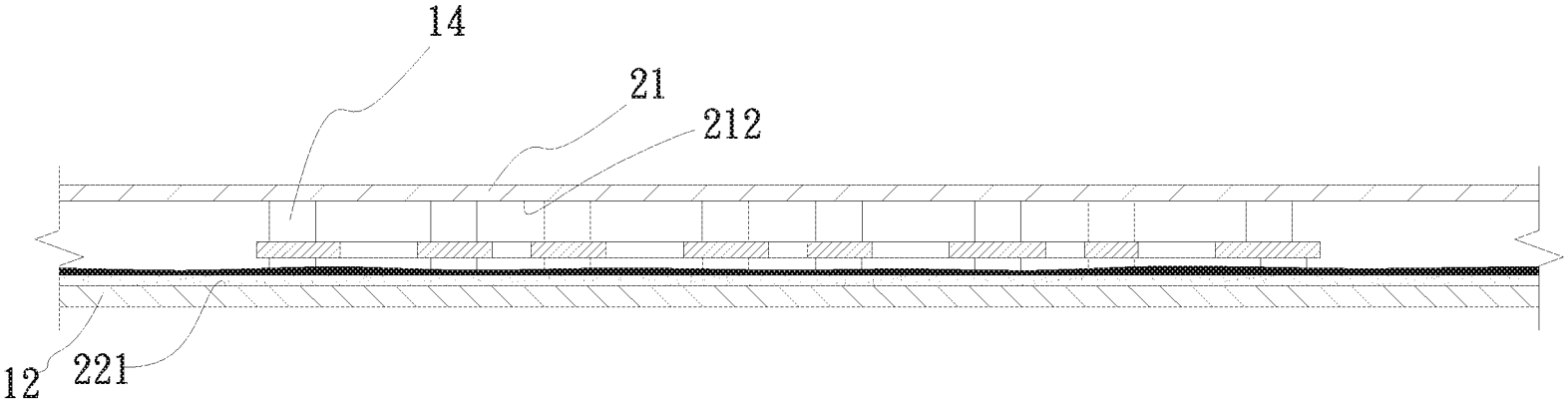
FIG. 7 is a sectional assembled view of a fourth embodiment of the vapor chamber of the present invention.

Please refer to FIG. 7, which is a sectional assembled view of a fourth embodiment of the vapor chamber of the present invention. The fourth embodiment is partially identical to the first embodiment in structure and thus will not be redundantly described hereinafter. The fourth embodiment is different from the first embodiment in that multiple support sections 14 are formed on one side of the sintered main body 1 opposite to the extension sections 12. The support sections 14 are connected with the second face 212 of the first plate body 21. The extension sections 12 and the support sections 14 are staggered from the perforations 11. The support sections 14 can be used instead of the support columns 6 of the above embodiment to prevent the first and second plate bodies from collapsing and/or thermal expansion.

In order to increase the working liquid content of the heated section of the vapor chamber, the conventional technique employs thickened capillary structure or multiple layers of capillary structures supported on (overlapped with) each other to increase the working liquid content of the heated section. This will lead to thermal resistance. It is a primary object of the present invention to improve the thermal resistance problem of the conventional vapor chamber. The present invention employs a sintered main body to increase the working liquid content of the heated section of the vapor chamber. The sintered main body has multiple extension sections. By means of the extension sections, the sintered main body and the first capillary structure define therebetween a gap so as to avoid thermal resistance due to the multiple layers of capillary structures, which are supported on (overlapped with) each other. In addition, the sintered main body has multiple perforations as a vertical path for the heated and evaporated working fluid to spread. This can effectively prevent the working fluid from accumulating in the heated section so as to improve the shortcoming of the conventional vapor chamber.

The present invention has been described with the above embodiments thereof and it is understood that many changes and modifications in such as the form or layout pattern or practicing step of the above embodiments can be carried out without departing from the scope and the spirit of the invention that is intended to be limited only by the appended claims.

What is claimed is:

1. A capillary structure of a vapor chamber comprising a plurality of support columns and a sintered main body having multiple perforations and multiple extension sections integrally extending from a first side of the sintered main body, the extension sections being arranged at intervals to support the sintered main body, the sintered main body being a porous structure formed of a plurality of powders and wherein the multiple perforations are configured to spread evaporated working fluid and wherein at least some of the multiple perforations are further configured with clearance for a corresponding one of the support columns to extend therethrough.

2. The capillary structure of vapor chamber as claimed in claim 1, wherein the perforations of the sintered main body pass through the sintered main body between the two sides thereof, each two adjacent extension sections defining therebetween a horizontal passage.

3. The capillary structure of vapor chamber as claimed in claim 1, wherein the sintered main body and the extension sections are integrally formed of sintered powder.

4. A vapor chamber comprising:

a first plate body having a first face and a second face;

a second plate body having a third face and a fourth face, the first and second plate bodies being correspondingly mated with each other to together define an airtight chamber, the third face having a first capillary structure and a heated section;

a working liquid filled in the airtight chamber;

a plurality of support columns; and a sintered main body having multiple perforations and multiple extension sections integrally extending from a first side of the sintered main body, the extension sections being arranged at intervals to support the sintered main body, the sintered main body being supported on and overlapped with the first capillary structure to define therebetween a gap, the sintered main body being a porous structure formed by a plurality of powders, and wherein the multiple perforations are configured to spread evaporated working fluid and at least some of the multiple perforations are further configured with clearance for the support columns to extend therethrough.

5. The vapor chamber as claimed in claim 4, wherein the first capillary structure is selected from a group consisting of mesh body, fiber body, woven body, channeled body and sintered powder.

6. The vapor chamber as claimed in claim 4, wherein the third face is formed with a dented section, the first capillary structure being disposed on a surface of the dented section, the extension sections of the sintered main body being connected with the first capillary structure.

7. The vapor chamber as claimed in claim 4, wherein two ends of the support columns are connected with the second face of the first plate body and the third face of the second plate body.

8. The vapor chamber as claimed in claim 4, wherein each two adjacent extension sections define therebetween a passage.

* * * * *